US006832693B2

(12) United States Patent
Schütz

(10) Patent No.: US 6,832,693 B2
(45) Date of Patent: Dec. 21, 2004

(54) TRANSPORT AND STORAGE CONTAINER FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 10/017,057

(22) Filed: Dec. 14, 2001

(65) Prior Publication Data

US 2002/0134780 A1 Sep. 26, 2002

(30) Foreign Application Priority Data

Dec. 16, 2000 (DE) ..... 200 21 321 U

(51) Int. Cl.[7] ..... B65D 25/14
(52) U.S. Cl. ..... 220/495.01; 206/386
(58) Field of Search ..... 220/495.01, 495.03, 220/495.04, 495.05, 23.91; 206/386

(56) References Cited

U.S. PATENT DOCUMENTS 4,851,286 A * 7/1989 Maurice ..... 428/316.6
5,253,777 A * 10/1993 Schutz ..... 220/571

FOREIGN PATENT DOCUMENTS

| | | |
|---|---|---|
| DE | 3905976 | 8/1990 |
| DE | 4206945 | 3/1993 |
| DE | 9407343 | 11/1994 |
| DE | 4433923 | 3/1996 |
| DE | 4209781 | 7/2000 |

* cited by examiner

*Primary Examiner*—Stephen Castellano
(74) *Attorney, Agent, or Firm*—Friedrich Kueffner

(57) ABSTRACT

A transport and storage container for liquids has an inner plastic container having an upper bottom with a fill socket, two sidewalls, a front wall with an outlet socket at the lower edge, a back wall, and a lower drainage bottom slanted toward the outlet socket. A pallet-shaped underframe has a support bottom for receiving the lower bottom of the inner container. The front wall of the inner container has a dome-shaped bulge where the outlet socket is arranged. Two bottom portions are arranged on opposed sides of the bulge and ascend from the lower bottom toward the front wall and the corner areas adjoining the front wall or toward the front wall and the sidewalls and the corner areas adjoining the front wall and the sidewalls. They form drainage surfaces for residual liquid to be drained from the forward bottom area into the outlet socket when removing residual liquid.

5 Claims, 8 Drawing Sheets

TRANSPORT AND STORAGE CONTAINER FOR LIQUIDS

BACKGROUND OF THE INVENTION

1. Field of the Invention

The invention relates to a transport and storage container for liquids, comprising an inner container made of plastic material having an upper bottom with a fill socket, two sidewalls, a front wall, comprising an outlet socket arranged at the lower edge area for connecting thereto a removal fitting for the liquid, a back wall as well as a lower bottom configured as a drainage bottom with a centrally arranged flat drainage channel which extends at a slight incline from the back wall of the container to a bottom sump provided in the lower bottom and adjoining the outlet socket in the front wall of the inner container, furthermore comprising an outer mantle comprised of metal grate or sheet metal as well as a pallet-like underframe which is provided with a support bottom supported on corner and center legs and configured for supporting the inner container and designed for manipulation by means of a transport device such as a forklift, shelf servicing device or the like.

2. Description of the Related Art

The plastic inner container of transport and storage containers for liquids of this kind, disclosed in German patent 42 06 945 C1, has at the lower area of its container front wall a central dome-shaped bulge for receiving the outlet socket and the removal fitting for the liquid. Because of this dome-shaped bulge in the container front wall, the portions of the lower bottom of the inner container adjoining the bulge and the lower edge area of the container front wall form traps for the liquid in which residual liquid is collected when emptying and cleaning the container. This liquid, upon renewed filling of the transport and storage container, can cause an impermissible contamination of the freshly filled-in liquid so that the container fulfills the required hygiene specifications, particularly in the case of transport and storage of liquid food articles such as juices and syrup, only to an unsatisfactory degree.

SUMMARY OF THE INVENTION

It is an object of the present invention to further develop a container of the aforementioned kind for transporting and storing liquids with respect to optimal emptying of residual amounts of liquid.

In accordance with the present invention, this is achieved in that the lower bottom of the inner container comprises, on both sides of a dome-shaped bulge in the container front wall for receiving the outlet socket and the removal fitting, two forward bottom portions with drainage surfaces for draining the residual liquid out of the forward bottom area of the inner container via the bottom sump into the outlet socket of the inner container during removal of residual liquid from the transport and storage container, wherein the two forward bottom portions ascend toward the container front wall and the adjoining corner areas or toward the front wall and the sidewalls and the adjoining corner areas.

In another embodiment, the front wall of the inner container has an inwardly projecting bulge extending over the entire width of the front wall and comprised of an inwardly projecting shoulder and an adjoining recessed vertical lower wall portion, wherein the outlet socket and the removal fitting are arranged centrally on the vertical lower wall portion.

By means of the forward bottom portions, having an incline opposite to the incline of the lower container bottom which descends slightly from the back wall to the front wall of the inner container of the lower bottom of the inner container, in accordance with the first embodiment of the transport and storage container according to the invention, on either side of the bulge in the container front wall, provided for receiving the outlet socket and the removal fitting, drainage surfaces are formed for guiding the residual liquid out of the forward bottom area of the inner container via the bottom sump into the outlet socket of the inner container during emptying of the residual liquid from the transport and storage container. This bottom construction enables a very good emptying of the residual liquid of the transport and storage container.

A further embodiment of the transport and storage container with an inner container according to the invention, wherein the container front wall has in the area of the lower container bottom a bulge which extends over the entire front wall width and has the central outlet socket for connecting thereto a removal fitting arranged centrally thereat, also prevents trapping of liquid so that an optimal emptying of the residual liquid is ensured wherein, however, as a result of the bulge in the front wall of the inner container a slight reduction of the volume of the transport and storage container must be accepted.

DESCRIPTION OF THE PREFERRED EMBODIMENTS

Figure 1:
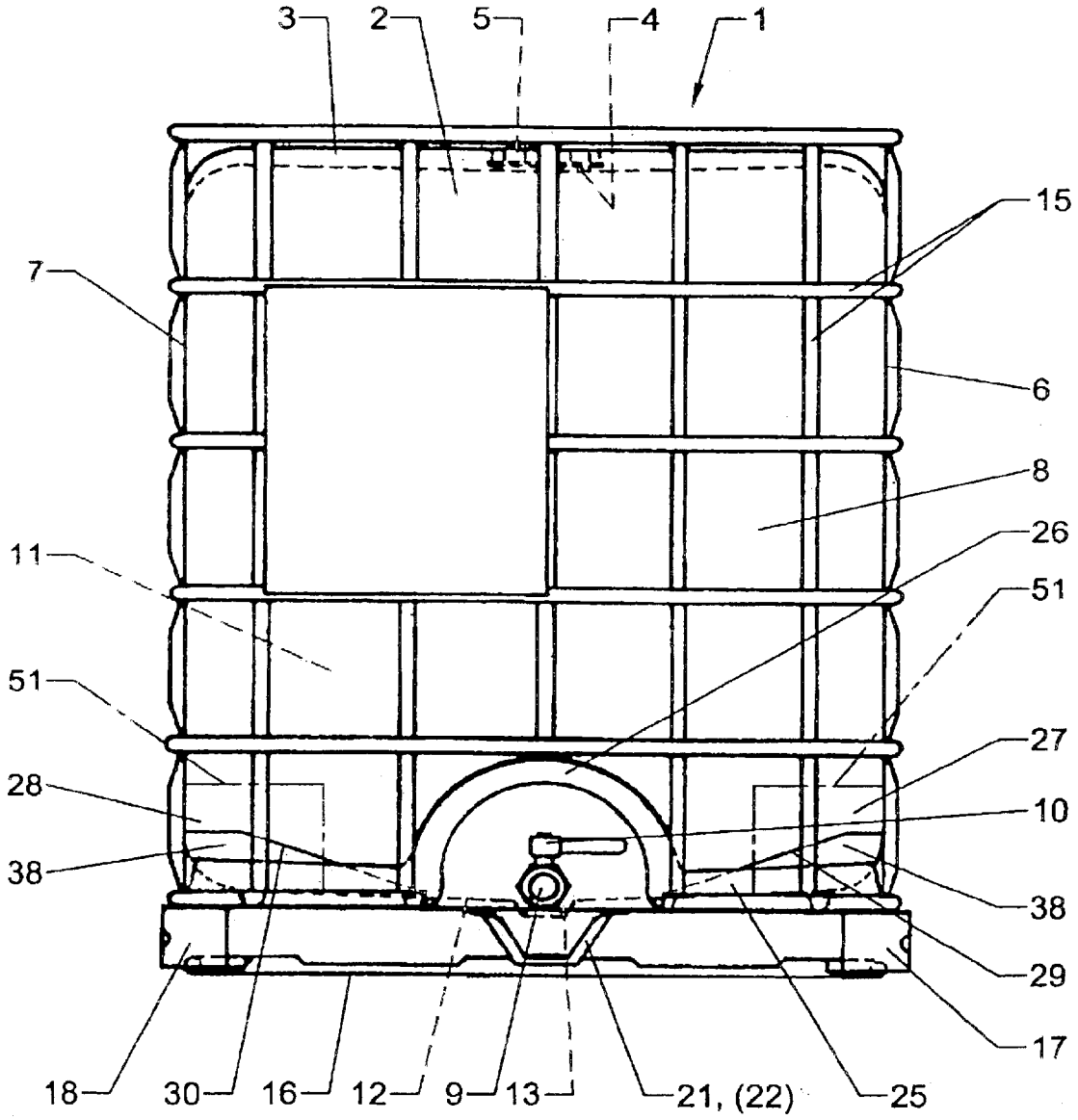
FIG. 1 shows a front view of the transport and storage container illustrating a first embodiment of the inner container.
Figure 2:
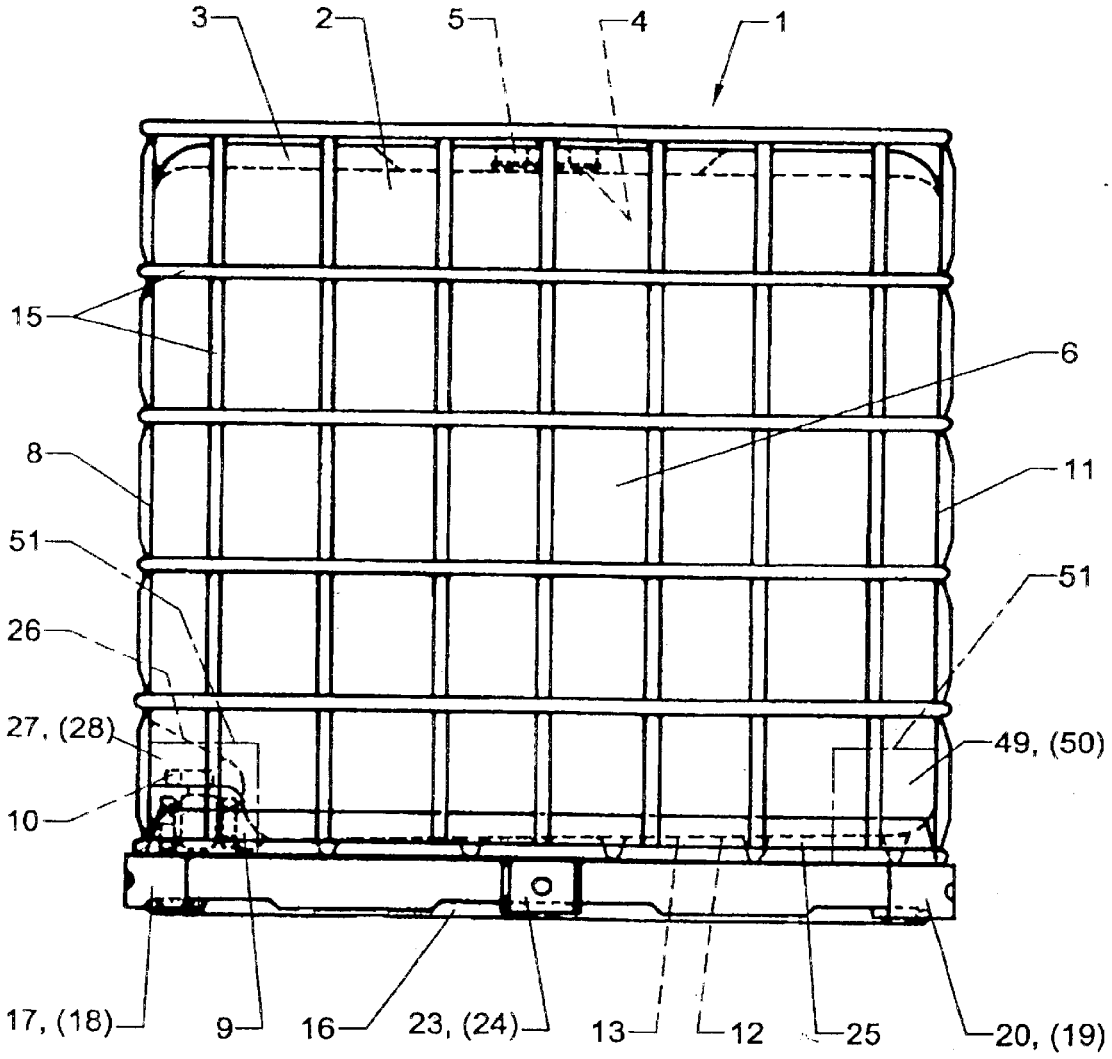
FIG. 2 is a side view of the container according to FIG. 1.
Figure 3:
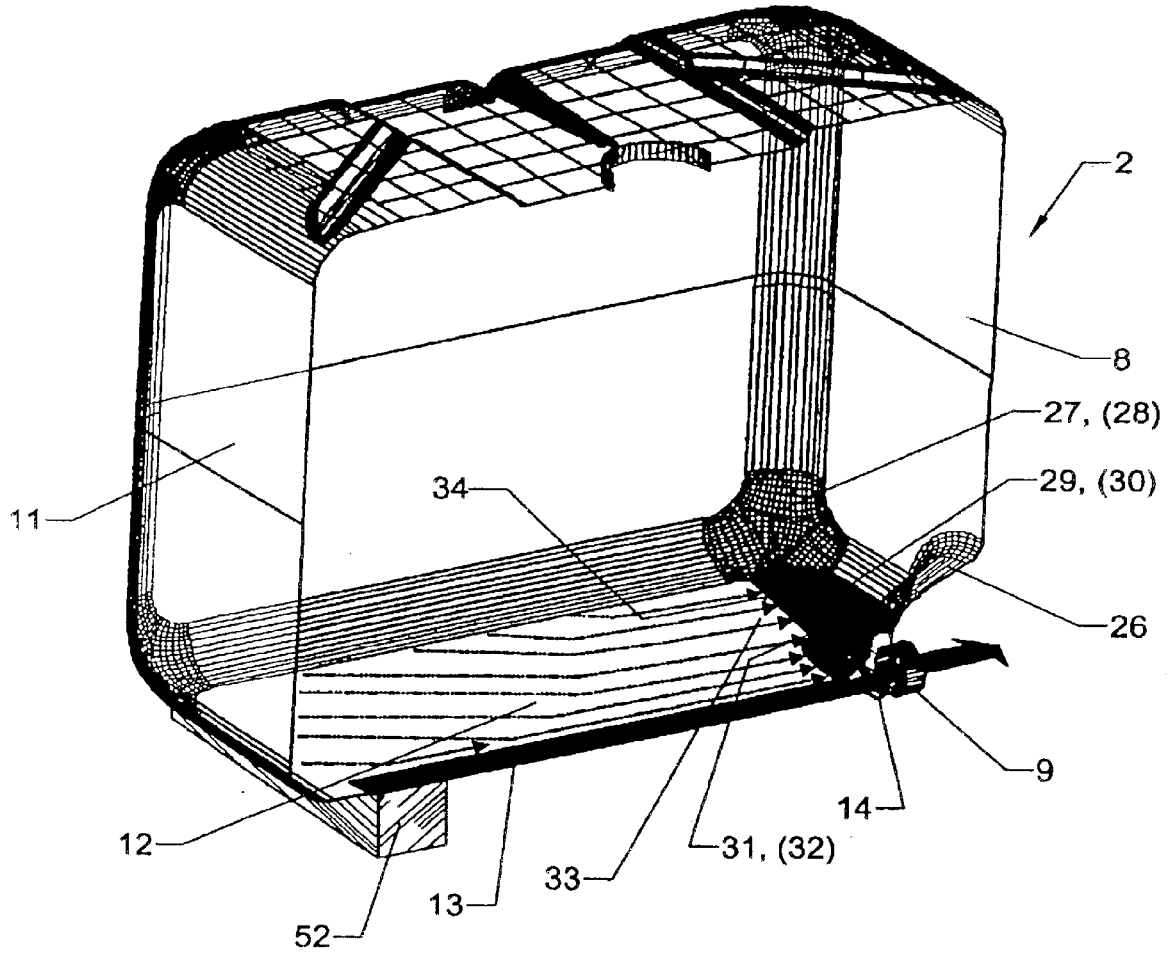
FIG. 3 is a perspective inner view of the inner container of the liquid container according to FIGS. 1 and 2.

The transport and storage container 1 for liquids, used as a disposable or multi-use container, according to FIGS. 1 through 3 has the following main components: an exchangeable parallelepipedal inner container 2 of plastic material with an upper bottom 3 comprising the fill socket 4 which can be closed by a screw lid 5; two sidewalls 6, 7; a front wall 8 with an outlet socket 9 arranged in the lower edge area and configured for connecting thereto a removal fitting 10 for the liquid, preferably a plug valve or ball valve; a back wall 11; as well as a lower bottom 12 configured as a drainage bottom with a centrally arranged flat drainage channel 13 which extends at a slight downward slant from the back wall 11 of the container 2 to a bottom sump 14 formed in the lower bottom 12 and adjoining the outlet socket 9 in the front wall 8 of the inner container 2.

Moreover, an outer mantle 15 comprised of a metal grade or sheet metal as well as a pallet-shaped underframe 16 are provided. The underframe 16 is provided with a support bottom 25 of a flat tub shape which is supported by corner legs 17–20 and central legs 21–24. The support bottom 25 is provided for supporting the inner container 2 and is configured to be manipulated by means of a forklift, shelf servicing device or similar transport means.

The lower bottom 12 of the inner container 2 according to FIGS. 1 to 3 has on either side of a dome-shaped bulge 26 in the front wall 8, configured for receiving the outlet socket 9 and the removal fitting 10, two forward bottom portions 29, 30 ascending toward the front wall 8 of the container and toward the adjacent corner areas 27, 28, respectively, providing drainage surfaces 31, 32 for draining the residual liquid out of the forward bottom area 33 of the inner container 2 via the bottom sump 14 into the outlet socket 9 of the inner container during removal of the residual liquid from the transport and storage container 1. The connecting edges 34 between lower bottom 12 and the two forward bottom portions 29, 30 forming drainage surfaces 31, 32 for the residual liquid extend transversely to the central drainage channel 13 of the lower container bottom 12.

Figure 4:
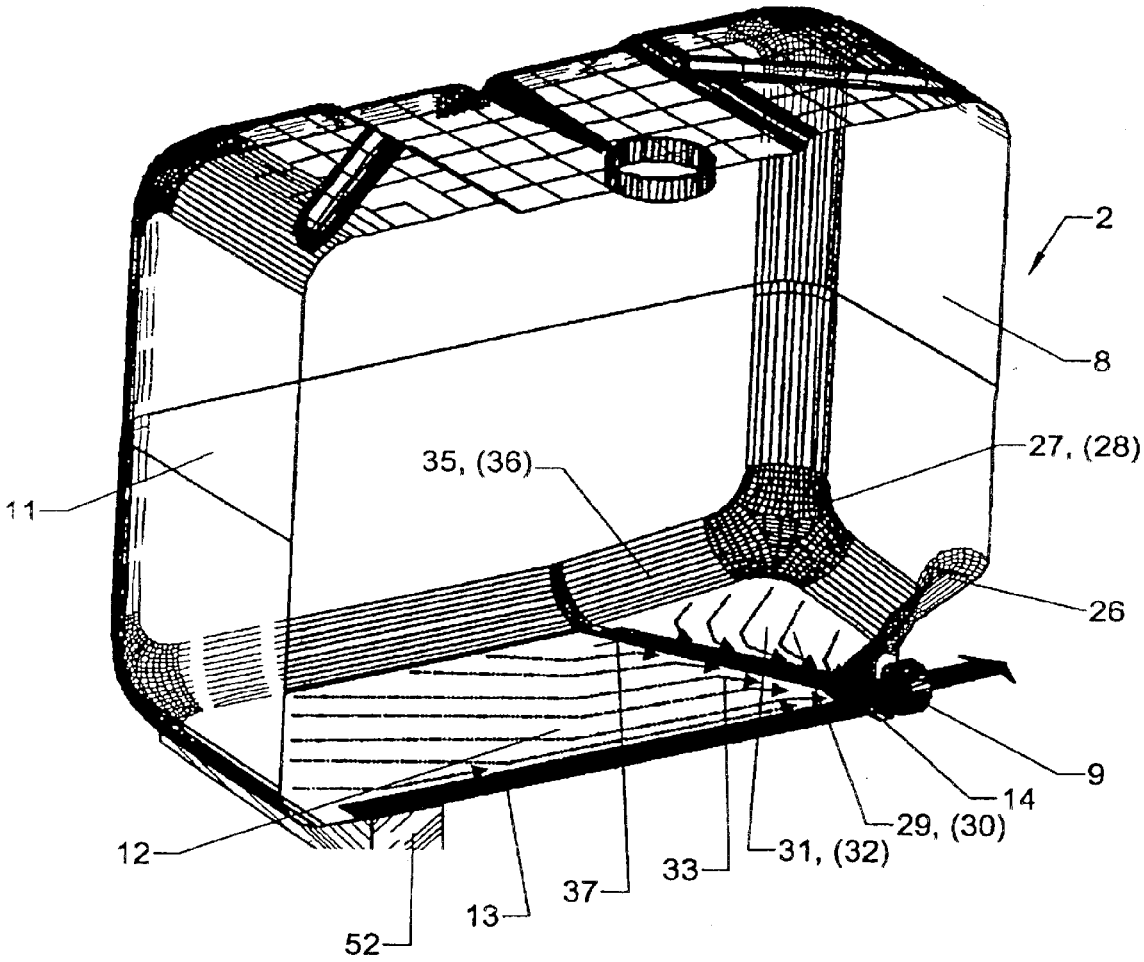
FIG. 4 is a perspective inner view of a further embodiment of the inner container.

In the inner container 2 illustrated in FIG. 4, the lower bottom 12 has two forward bottom portions 29, 30 on either side of the bulge 26 within the front wall 8 of the container which ascend toward the front wall 8 of the container and toward the adjoining corner and sidewall areas 27, 35; 28, 36 of the inner container 2. The connecting edges 37 between the lower bottom 12 of the inner container 2 and the forward bottom portions 29, 30 extend at a slant to the central drainage channel 13 of the lower container bottom 12.

In the two embodiments of the inner container 2 of the transport and storage container 1 illustrated in FIGS. 1 through 4, the forward bottom portions 29, 30 on either side of the bulge 26 in the front wall 8 of the inner container 2 are supported by support elements 38 made of plastic material which rest against the bottom 25 of the underframe 16 of the transport and storage container 1.

Figure 5:
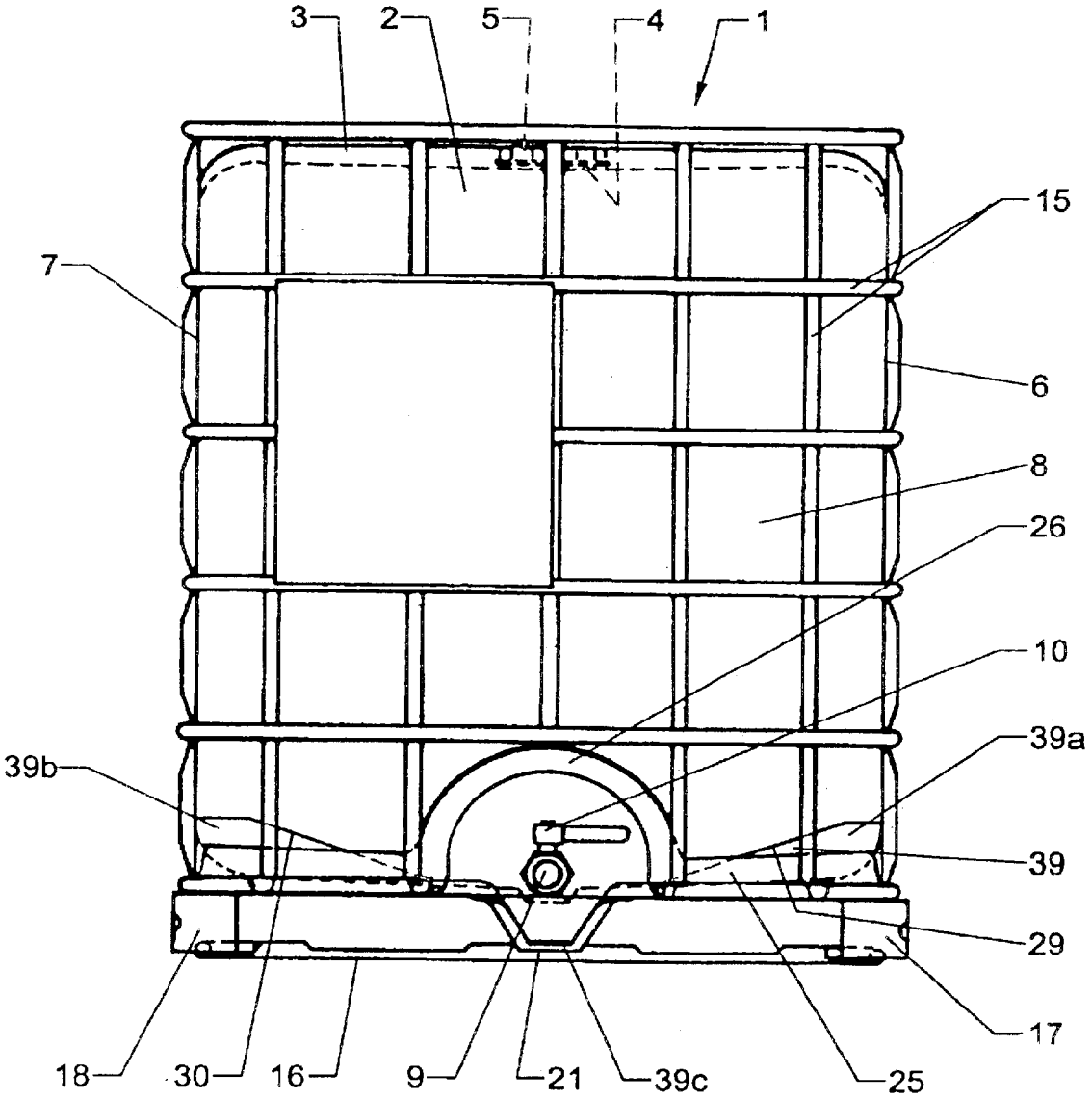
FIG. 5 is a front view of a transport and storage container with a support action of the inner container modified relative to the container embodiments of FIGS. 1 through 4.

In the transport and storage container 1 for liquid illustrated in FIG. 5, a support member 39 of plastic material is positioned on the support bottom 25 of the underframe 16. It has two outer support elements 39*a*, 39*b* for supporting the forward bottom portions 29, 30 on either side of the bulge 26 in the front wall 8 of the inner container 2 as well as a central part 39*c* connecting the two support elements 39*a*, 39*b* with one another. The central part 39*c* covers the forward central leg 21 formed on the bottom 25 of the underframe 16 in a form-fitting way and provides protection against liquids, particularly, aggressive liquids, dripping from the removal fitting 10.

Figure 6:
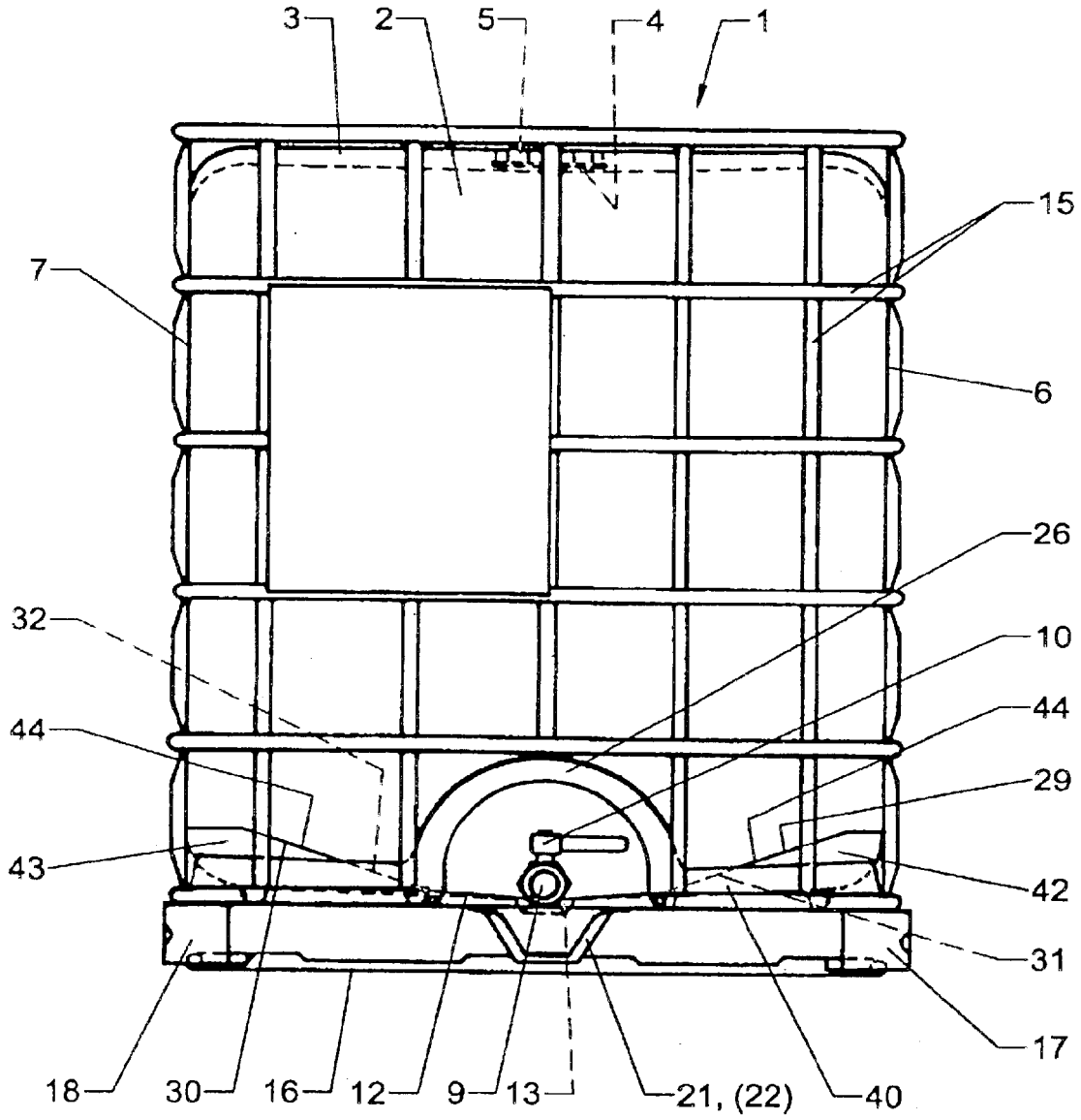
FIG. 6 is a front view of a transport and storage container with a third embodiment of the inner container.
Figure 7:
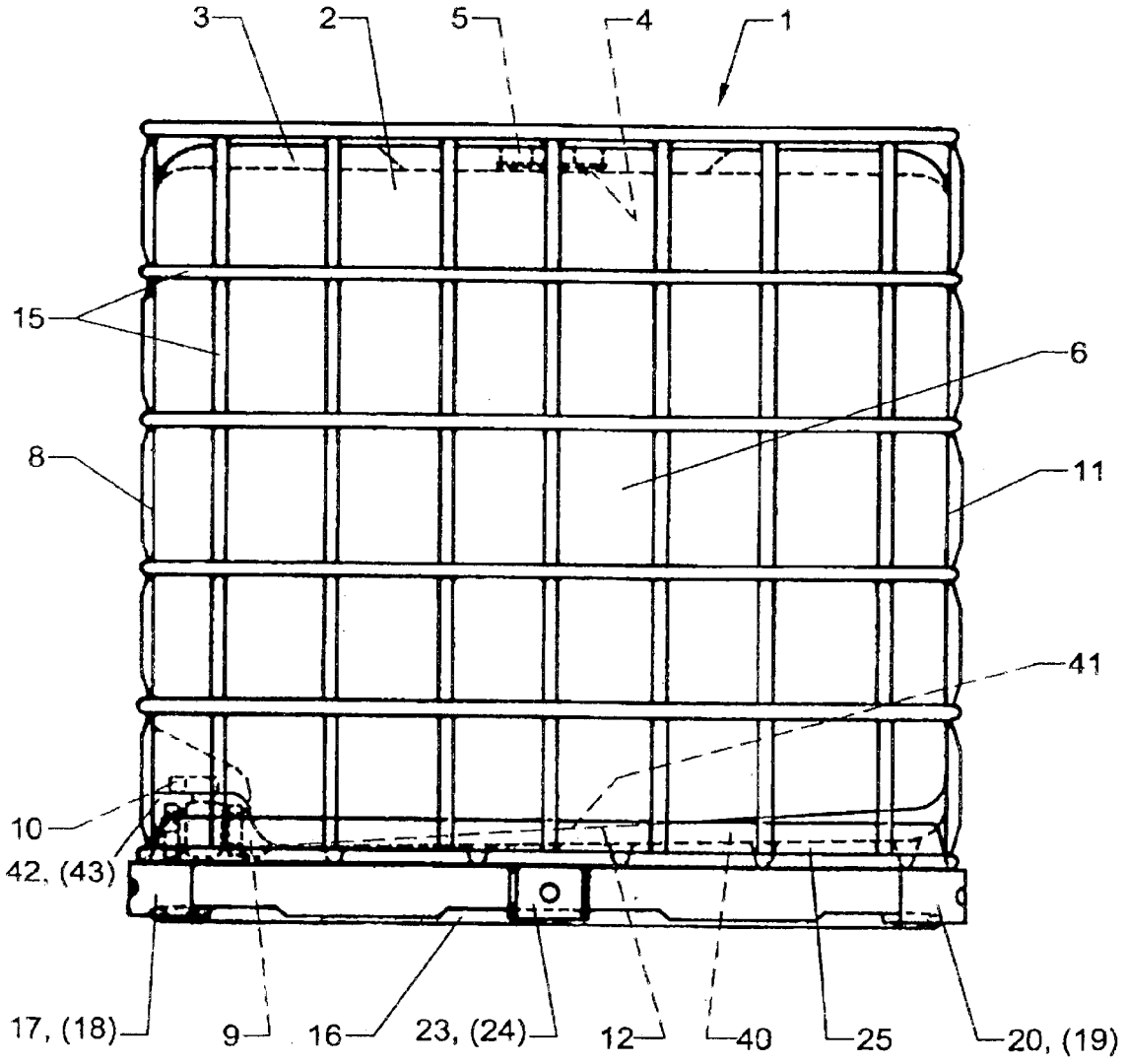
FIG. 7 is a side view of the container according to FIG. 6.

The transport and storage container 1 for liquids according to FIGS. 6 and 7 is provided with an inner container 2 with a lower bottom 12 whose incline from the container back wall 11 to the outlet socket 9 arranged at the front wall 8 of the container is greater than the incline of the support bottom 25 of underframe 16. Also provided is an insert bottom 40 made of plastic material positioned between the inner container 2 and the support bottom 25 of the underframe 16. It has an upper slanted surface 41 matched to the lower bottom 12 formed as a drainage bottom of the inner container 2 as well as two forward insert bottom portions 42, 43 with slanted top sides 44 for supporting the two front bottom portion 29, 30 of the lower bottom 12 of the inner container 2 forming drainage surfaces 31, 32 for the residual liquid.

Figure 8:
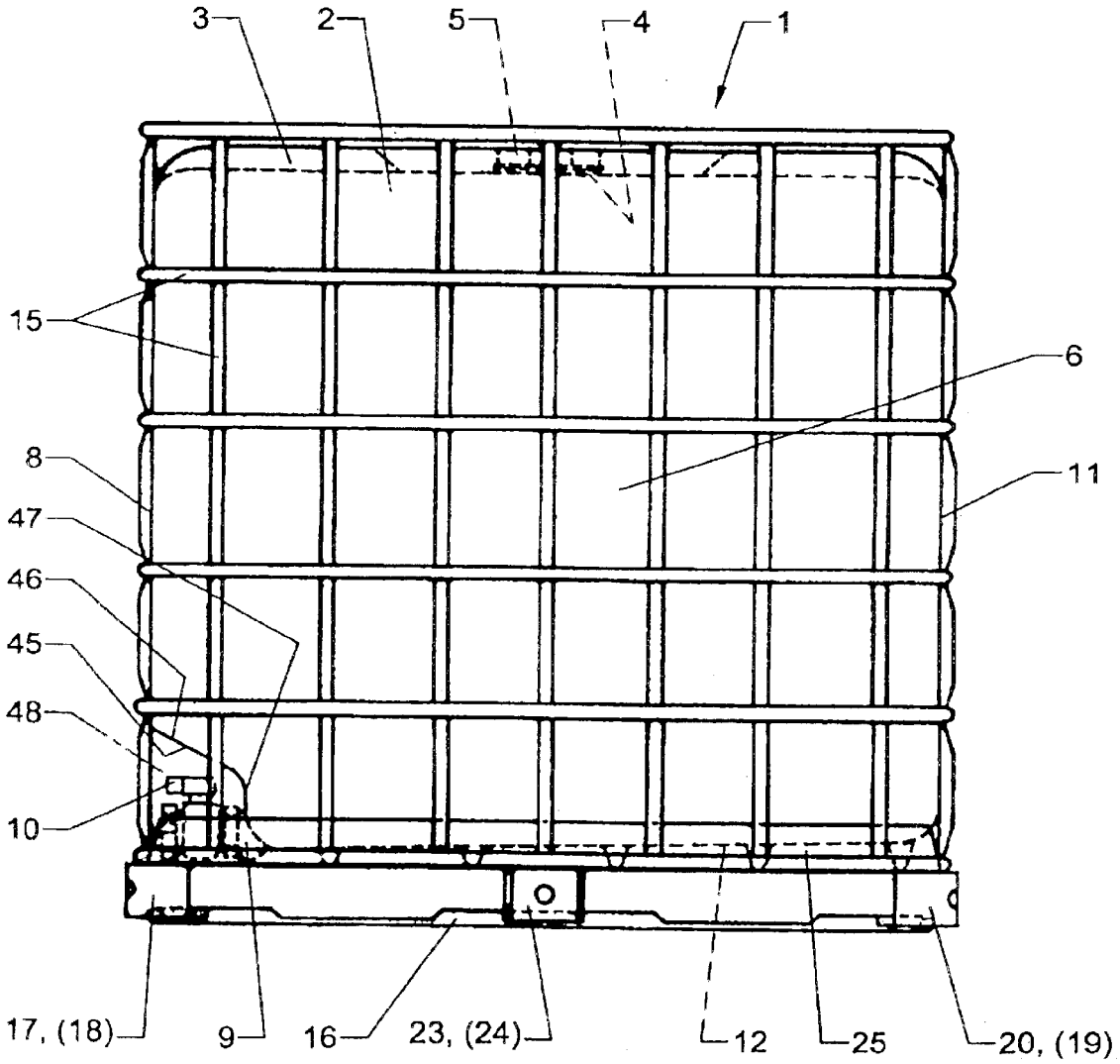
FIG. 8 is a side view of a transport and storage container with a fourth embodiment of the inner container.

The front wall 8 of the inner container 2 of the transport and storage container 1 illustrated in FIG. 8 has in the area of the lower bottom 12 a bulge 45 extending over the entire wall width. The bulge 45 is formed by a slightly slanted inwardly projecting shoulder 46 and an adjoining recessed vertical lower wall portion 47 provided with a centrally arranged outlet socket 9 for receiving a removal fitting.

The bulge 45 in the front wall 8 of the inner container 2 of the transport and storage container 1 for liquids according to FIG. 8 can be supported by a one-part or multi-part insert 48 of plastic material positioned on the support bottom 25 of the underframe 16.

The lower part of the front and rear corner areas 27, 28, 49, 50 of the inner container 2 of the transport and storage container 1 can be protected and covered by corner protection devices 51 (FIGS. 1 and 2).

For accelerating the removal of the residual liquid, in particular, for viscous liquids such as syrup, the rearward part of the pallet-shaped underframe 16 of the transport and storage container 1 or the rear part of the inner container 2, after removal from the outer mantle 15, can be lifted with an auxiliary part, for example, a squared beam 52 (FIGS. 3 and 4).

While specific embodiments of the invention have been shown and described in detail to illustrate the inventive principles, it will be understood that the invention may be embodied otherwise without departing from such principles.

What is claimed is:

1. A transport and storage container for liquids, comprising:

an inner container of plastic material having an upper bottom with a fill socket, two sidewalls, a front wall having an outlet socket arranged within a lower edge area of the front wall and configured to receive a removal fitting, a back wall, and a lower bottom configured as a drainage bottom having a central, flat drainage channel extending at a downward slant from the back wall to a bottom sump provided within the lower bottom and adjoining the outlet socket;

an outer mantle comprised of a metal grate or a sheet metal;

a pallet-shaped underframe comprising a support bottom, configured to receive the lower bottom of the inner container, and comprising corner legs and center legs connected to the support bottom, wherein the underframe is configured to be handled by transport devices;

wherein the front wall of the inner container has an inwardly projecting dome-shaped bulge, wherein the outlet socket and the removal fitting are arranged within the bulge;

comprising two forward bottom portions arranged on opposite sides of the bulge, wherein the two forward bottom portions ascend from the lower bottom toward the front wall and the corner and sidewall areas adjoining the front wall, wherein the two forward bottom portions form drainage surfaces for draining residual liquid from a forward bottom area of the inner container via the bottom sump into the outlet socket when emptying the transport and storage container for removing residual liquid, and wherein the two forward bottom portions comprise connecting edges between the lower bottom and the drainage surfaces, wherein the connecting edges extend slantedly to the drainage channel and in the direction to the outlet socket.

2. The transport and storage container according to claim 1, and further comprising plastic support elements resting against the support bottom and configured to support the two forward bottom portions.

3. The transport and storage container according to claim 1, further comprising a plastic support member resting against the support bottom, wherein the plastic support member comprises two outer support elements configured to support the two forward bottom portions and a center part connected to the two outer support elements, wherein the center part covers form-fittingly a front center leg of the underframe and provides a protection against liquid dripping from the removal fitting.

4. The transport and storage container according to claim 1, further comprising a plastic insert bottom arranged between the support bottom and the lower bottom of the inner container, wherein the lower bottom has a first slant from the back wall to the outlet socket and wherein the support bottom has a second slant, wherein the first slant is greater than the second slant, wherein the plastic insert bottom has a slanted upper insert bottom surface matching the lower bottom of the inner container and has two forward insert bottom portions with slanted top sides configured to support the forward bottom portions.

5. The transport and storage container according to claim 1, comprising corner protection devices configured to protect and cover the corner areas of the inner container.

* * * * *